343-756 SR
5/12/87 OR 4,665,405

United States Patent [19]
Drabowitch et al.

[11] Patent Number: 4,665,405
[45] Date of Patent: May 12, 1987

[54] ANTENNA HAVING TWO CROSSED CYLINDRO-PARABOLIC REFLECTORS

[75] Inventors: Serge Drabowitch, Chatenay Malabry; Claude Aubry, Crigny; Daniel Casseau, Fontenay Aux Roses; Jean Bouko, Villemoisson sur Orge, all of France

[73] Assignee: Thomson-CSF, Paris, France

[21] Appl. No.: 684,462

[22] Filed: Dec. 21, 1984

[30] Foreign Application Priority Data

Dec. 30, 1983 [FR] France ..... 83 21098

[51] Int. Cl.[4] ..... H01Q 19/20; H01Q 19/195
[52] U.S. Cl. ..... 343/756; 343/781 P
[58] Field of Search ..... 343/756, 781 P, 781 CA, 343/840

[56] References Cited

U.S. PATENT DOCUMENTS 2,597,391 4/1942 Sichak ..... 343/756
3,820,116 6/1974 Carlsson et al. ..... 343/756
4,024,543 5/1977 Vokurka ..... 343/781 P
4,574,287 3/1986 Waters ..... 343/756

FOREIGN PATENT DOCUMENTS 7624561 8/1976 France .
7906135 3/1979 France .
633061 12/1949 United Kingdom .

*Primary Examiner*—Eli Lieberman
*Attorney, Agent, or Firm*—Roland Plottel

[57] ABSTRACT

An antenna having two crossed cylindro-parabolic reflectors in which the generatrices of said reflectors are orthogonal. The source is placed close to the center of the main reflector, which is further provided with polarization rotation means. The auxiliary reflector is placed facing the main reflector and it is such that it is transparent to a wave polarized linearly in one direction and reflecting to the waves polarized in an orthogonal direction.

3 Claims, 5 Drawing Figures

ANTENNA HAVING TWO CROSSED CYLINDRO-PARABOLIC REFLECTORS

BACKGROUND OF THE INVENTION

The present invention relates to an antenna having two crossed cylindro-parabolic reflectors with polarization rotation, for transmitting and/or receiving microwaves. It also relates to a process for manufacturing this antenna.

In some applications, it is necessary to have antennae in which the width (at half power) of the radiated beam is not identical in elevation and in bearing. For example, for a tracking antenna capable of tracking a target flying a low altitude, a maximum beam width in bearing is required for a minimum width in elvevation, so as to avoid parasitic reflections from the ground.

To obtain such an antenna, called a dissymmetric antenna, it is possible to use a microwave source emitting a beam whose width is different in the elvational and bearing directions. However, such a source proves to have poorer characteristics than a symmetrical source.

More particualalry, in such a source, the phase centers are different in elevation plane and in bearing plane. Further, for each of them, its locations varies with the frequency of the emitted microwave. The effect is a defocusing of the beam and thus, and increasing of the sidelobes of the radar pattern, which is a well known drawback. More generally, the more different is the radiated pattern of the source in elevation plane from what it is in bearing plane, the less constant with frequency the characteristics of the source. The result is that these dissymetric antennae are limited in relation with the bandwidth and/or the ratio of the widths of the beams in elevation plane and in bearing plane.

SUMMARY OF THE INVENTION

It is an object of the invention to provide and antenna avoiding this disadvantage by use of a source having substantially the same radiation in both planes, elevational and bearing, the disymmetry being obtained by means of two cylindro-parabolic reflectors whose generatrices are orthogonal. The source is placed preferably in the vicinity of the center of one of the reflectors, called main reflector, which is further provided with polarizing rotation means. The second reflector, called auxiliary reflector, is placed opposite the preceding one and it is such that is is transparent to microwaves of given polarization and such that it reflects microwaves with polarization orthogonal to the preceding one.

More specifically, according to the invention there is provided an antenna adapted for receiving a source capable of emitting and/or receiving microwaves polarized in a first direction and having a radiation diagram substantially of revolution said antenna comprising an auxiliary reflector capable of receiving the preceding wave for reflecting it to a main reflector, said auxiliary reflector being cylindrical in shape, the director curve of the cylinder being a parabola situated in a plane parallel to said first direction and the generatrix of the cylinder being perpendicular to said first direction, said auxiliary reflector comprising, deposited on its surface, an array of wires parallel to said first direction; said main reflector being cylindrical in shape, the director curve of this cylinder being a parabola situated in a plane perpendicular to said first direction and its generatrix being parallel to said first direction; said reflectors being placed facing each other so that the phase center of said source is at the focus of said auxiliary reflector and the centers of said reflectors are aligned with their foci, thus forming the axis of said antenna; said antenna further comprising means for rotating the polarization of the wave striking said main reflector, said microwave emitted by said source being thus reflected a first time by said auxiliary reflector towards said main reflector, and reflected a second time by sain main reflector towards said auxiliary reflector, at the same time as its polarization undergoes a rotation, the emergent wave then being transmitted by said auxiliary reflector.

This arrangement, called centered arrangement, in which the centers of the reflectors are aligned with the phase center of the source along the axis of the antenna, provides a particularly compact structure.

A further object of the invention is to provide a process for manufacturing such an antenna.

BRIEF DESCRIPTION OF THE DRAWINGS

Other objects, freatures and results of the invention will be clear from the following description given by way of non limitative example and illustrated by the accompanying drawings which show.

In these different figures, the same references refer to the same elements.

DESCRIPTION OF THE PREFERRED EMBODIMENT

Figure 1:
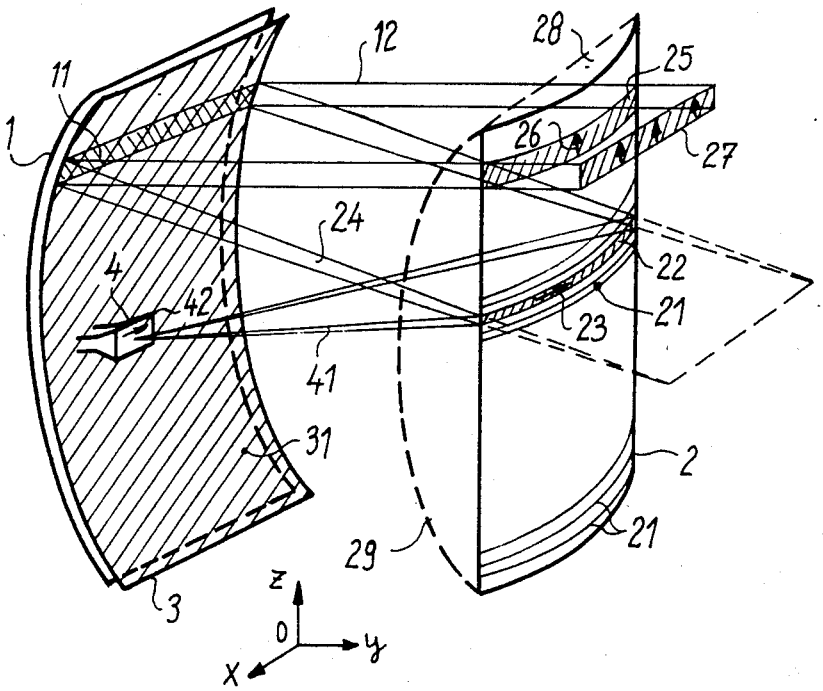
FIG. 1, an exploded perspective view of one embodiment of the antenna of the invention.

In FIG. 1, one embodiment of the antenna of the invention has been shown in an exploded perspective view.

As was mentioned above, this antenna is intended to receive and to transmit microwaves. However, its operation will be described here in the case of transmission only, so as to simplify the description.

In this FIG. 1, it can seen:

a source 4 capable of emitting or receiving a linearly polarized microwave and whose radiaiton diagram is substantially of revolution. In the figure, the polarization (arrow 42) is parallel to a direction OX of an orthonormed reference OXYZ, and the source is shown by way of example in the form of a horn.

a first reflector 1, called main reflector, cylindrical in shape. The director curve of the cylinder is a parabola, situated in the plane YOZ, perpendicular to the preceding direction (OX). The generatrix of the cylinder is parallel to OX.

a second reflector 2, called auxiliary reflector, which is cylindrical in shape. The director curve of the cylinder is a parabola situated in the plane XOY and its generatrix is perpendicular to this plane, i.e. parallel to OZ.

means 3 for rotating the polarization of a wave striking the main reflector 1.

The two reflectors 1 and 2 thus each appear to be cylindro-parabolic, their generatrices being orthogonal. They are placed opposite each other so that the structure defines a plane of symmetry passing through center $O_1$ and $O_2$ of the two reflectors 1 and 2, respectively. Source 4 is centered, that is to say that it is placed so that its phase center is situated preferably in the vicinity of reflector 1 along axis $O_1$ $O_2$ forming the axis of the antenna.

The auxiliary reflector 2 is formed by a dielectric substrate covered with conducting wires 21, parallel to the direction (OX) of polarization of the wave emitted by source 4. Reflector 2, which is a developable surface, is formed for example from a flat dielectric plate on which are deposited metallizations in the form of rectilinear and parallel strips, for forming the wires 21, in accordance with the technology used for manufacturing printed circuits. The plate then is shaped as a parabolic cylinder. The function of wires 21 is, as is known, to reflect the electromagnetic waves whose polarization is parallel thereto and to transmit, without disturbing them, the waves whose polarization is perpendicular thereto. It follows from the foregoing that the radiation emitted by source 4, shown in FIG. 1 by a beam 41, strikes the auxiliary reflector 2 (hatched zone 22) and is there reflected as a whole to the main reflector 1 (beam 24), its polarization (parallel to OX) being kept (arrow 23).

The means 3 for rotating the polarization of the wve striking the main reflector 1 are formed, as is known, by a dielectric foil in the form of a parabolic cylinder defining the same focal point as reflector 1, placed at a distance from the reflectro 1 of the order of $\lambda/4$ or of uneven multiples of $\lambda/4$.

$\lambda$ being the wave length of the wave emitted by source 4. The dielectric foil comprises an array of conducting wires 31, parallel to each other and forming an angle of 45° with the polarization of the incident wave which is parallel to OX in this example. Since the polarization rotating means 3 have the same shape as reflector 1, which is a developable surface, they may be formed like the auxiliary reflectro 2 from a dielectric foil on which metallizations forming wires 31 are deposited flat. However, since wires 31 are not, like wires 21, orthogonal to the generatrix of the cylinder, they are not straight lines on the developed surface but a curve close to a straight line, intersecting axis OXZ at an angle of 45° . The equations to which this curve obeys are determined by considering that the polarization of the wave reflected in the direction of the auxiliary reflector by the main reflector assembly and polarization rotation means must be in the plane defined by this reflected ray and the tangent to the director parabola of the auxiliary reflectro, at the point where this reflected ray strikes the auxiliary reflector. By calculating the components of the reflected electric field and by writing that they must satisfy this condition, a first relationship is obtained. Further, considering the cylindro-parabolic surface of the polarization rotation means, the coordinates of any point (M) are written as a function of a coordinate (x) taken parallel to the generatrix of the parabolique cylinder 3 and of the angle ($\phi$) which the straight line $O_1F$ forms with the plane passing through M and F and normal to the director parabola of means 3, the point of origin of the coordinates being taken at the center of means 3 and F being the focus of the main reflectro 1. Thus a second relation is obtained which, put together with the first one, gives the following relationship:

$$\frac{dx}{d\phi} = \frac{f_1}{2f_2\cos^2\phi/2} \cdot [x \cdot \sin\phi \pm \sqrt{4f_2^2 + x^2\sin^2\phi}\,] \quad (1)$$

where $f_1$ and $f_2$ are the focal distances respectively of the means 3 and of the auxiliary reflector. The curvilinear abscissa (S) of the director parabola is further written as a function of $\phi$, which gives:

$$S = f_1 \cdot \left[ \frac{\sin\phi/2}{\cos^2\phi/2} + \tfrac{1}{2} \cdot \mathrm{Log}\,\frac{1 + \sin\phi/2}{1 - \sin\phi/2} \right] \quad (2)$$

Thus a two equation system is obtained (1) and (2), which are $\phi$ parametered, defining the curve to which wires 31 are parallel.

The main reflectro 1 is formed by any known means, such as a honey comb structure, covered with a metallized skin. Means 3 are for example held on reflector 1 by means of distance pieces, disposed unevenly preferably.

Means 3, as is also well known, causes the polarization of the instant wave to rotate through 90°. the wave received (zone 11 in the figure) by the main reflector 1 with its means 3, has its polarization therefore rotated so that it becomes parallel to the direction OZ. It is reflected (beam 12) in the direction of the auxiliary reflector 2, but since its polarization (arrow 26) is then perpendicular to wires 21 (zone 25), the wave is transmitted as a whole by the reflector 2 (zone 27).

Figure 2:
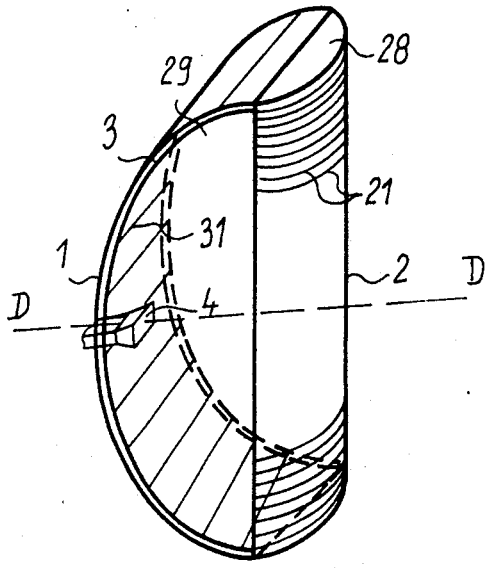
FIG. 2, a perspective view of the same embodiment, the different elements being assembled together.

In FIG. 2 has been shown a perspective view of the preceding antenna, the different component elements described above being assembled together.

We find again in this figure the two reflectors 1 and 2 placed opposite each other, source 4 placed in the vicinity of the center of reflector 1 and the polarization rotation means 3 placed along the main reflector 1.

As can be seen in FIG. 2, the auxiliary reflector 2 may be extended by two side parts 29 and two horizontal parts 28, one lower and the other upper, also shown in FIG. 1, which are placed on the edges of reflector 1 so as to form a radome for the antenna for protecting it.

Figure 3:
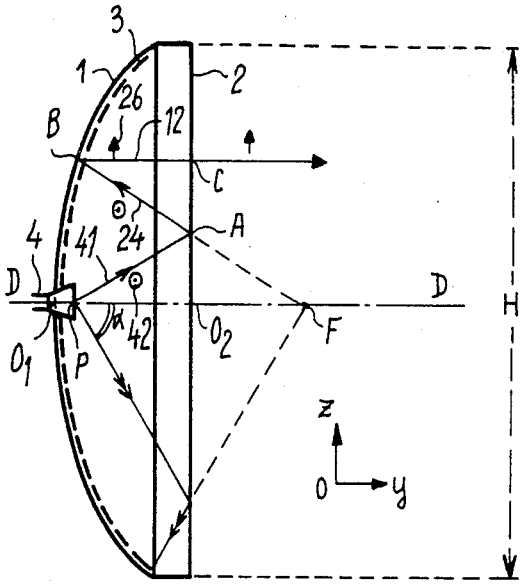
FIG. 3, a diagram for explaining the structure of FIG. 1, seen in a side view.

FIG. 3 is a diagram illustrating the path of a microwave, the diagram being made in the plane YOZ, i.e. the antenna is side viewed.

The wave is emitted by source 4 from a point P, phase center of the source, close to center $O_1$ of the main reflector, in the form of a spherical wave (shown by ray 41) whose polarization (arrow 42) is parallel to OX. Point P is chosen as being the focus of reflector 2. Wave 41 is reflected (at A) by the auxiliary reflector 2, and becomes a cylindrical wave whose axis is orthogonal to that of reflector 2. This cylindrical wave (shown by ray 24) is reflected (at B) by the main reflector 1, A and B being such that they are aligned with the focus F of the main reflector 1, which means that $PO_2 = O_2F$. At B, there is a rotation of the polarization through 90° (shown by arrow 26) and transformation of cylindrical wave into a plane wave. From point B the energy is propagated parallel to the axis DD of the antenna passing through the centers $O_1$ and $O_2$ of the reflectors, and passes through the auxiliary reflector at C with out disturbance.

It follows from the foregoing that the spherical wave emitted by source 4 is transformed by elements 1, 2 and 3 into a plane wave, emitted parallel to the axis of the antenna. The opening of the antenna is different in the two orthogonal planes: equal to H in one plane and to L in the other; if we chose H>L, knowing that the width of a half power beam is inversely proportional to the opening of the antenna, it can be seen that the width of the beam in the plane YOZ, which may be the elevational plane, is less than the width of this beam in the orthogonal plane, which is then the bearing plane the ratio of the width being able to exceed 2 without difficulty.

Furthermore, the maximum angle $\alpha$ has been shown in FIG. 3 at which the main reflector 1 is seen from point P. If we designate by $\beta$ the maximum angle at which the auxiliary reflector 2 is seen from point P, it can be written that:

$$\frac{O_1F \cdot \tan \alpha/2}{O_2P \cdot \tan \beta/2} = \frac{H}{L}$$

where H is the height of the antenna (opening of the director parabola of the main reflector) and L its width (opening of the director parabola of the auxiliary reflector). In the preferred case where $\alpha=\beta$ or $\alpha \simeq \beta$, it can be seen that the openings of the two reflectors are in the ratio of their focal distances.

Figure 4:
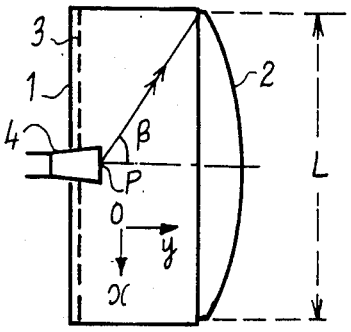
FIG. 4, a top view of the antenna of FIG. 1.

In FIG. 4, the above described antenna has been shown seen from above, i.e. in the plane XOY.

We find again the source 4, the main reflector 1 plotted as a straight line, the auxiliary reflector 2 and the polarization rotation means 3.

There is further shown the maximum angle $\beta$ at which the auxiliary reflector 2 is seen from point P.

Figure 5:
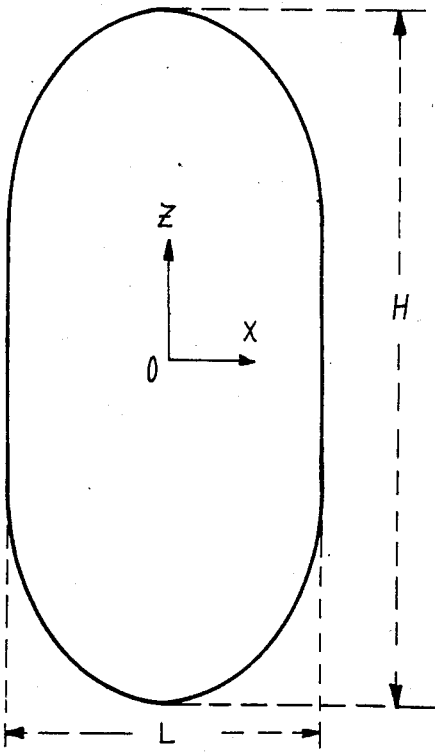
FIG. 5, one embodiment in a front view of the antenna of FIG. 1.

FIG. 5 is the front view of the above described antenna, i.e. seen in the plane XOZ, showing by way of example the shape which the antenna may have, namely substantially an ellipse. However, other forms may of course be considered, such as a rectangle, possibly with cut off corners, etc. . . .

By way of example, the above described antenna has been constructed with the following dimensions:

$O_1F=0.88$ mm
$PO_2=0.415$ m
$O_1P=5$ cm
width $L=0.85$ m
height $H=2.2$ m
$\alpha=64°$
$\beta=54°$ Thus a two reflector antenna with polarization rotation has been described, one of the reflectors being semi transparent (transparent to a single direction of polarization), which provides a compact centered system. Furthermore, the crossed cylindro-parabolic reflectors allow on the one hand beams to be obtained having different widths in elevation and in bearing without causing the known disadvantages of sources whose radiation diagram is not of revolution and, on the other hand, the technological construction of the antenna to be facilitated, the parabolic cylinders being developable surfaces and elements 2 and 3 being therefore able to be manufactured flat. Finally, the auxiliary reflector 2 further supplies a filtering function: it avoids the presence of crossed polarization in the vicinity of the axis of the antenna.

Such an antenna is particularly switable for tracking low altitude targets.

What is claimed is:

1. An antenna adapted for receiving a source capable of emitting and/or receiving microwaves polarized in a first direction and having a radiation diagram substantially of revolution said antenna comprising an auxiliary reflector capable of receiving the preceding wave for reflecting it to a main reflector, said auxiliary reflector being cylindrical in shape, the director curve of the cylinder being a parabola situated in a plane parallel to said first direction and the generatrix of the cylinder being perpendicular to said first direction, said auxiliary reflector comprising, deposited on its surface, an array of wires parallel to said first direction: said main reflector being cylindrical in shape, the director curve of this cylinder being a parabola situated in a plane perpendicular to said first direction and its generatrix being parallel to said first direction; said reflectors being placed facing each other so that the phase center of said source is at the focus of said auxiliary reflector and the centers of said reflectors are aligned with their foci, thus forming the axis of said antenna; said antenna further comprising means for rotating the polarization of the wave striking said main reflector, said microwave emitted by said source being thus reflected a first time by said auxiliary reflector towards said main reflector, and reflected a second time by said main reflector towards said auxiliary reflector, at the same time as its polarization undergoes a rotation, the emergent wave then being transmitted by said auxiliary reflector.

2. The antenna as claimed in claim 1, wherein said polarization rotation means comprise a dielectric foil substantially of the same shape and having the same focus as said main reflector, placed at a distance of the order of a quarter of the incident wave length, or of an uneven multiple thereof, said dielectric foil supporting an array of conducting wires parallel to each other and forming an angle of 45° with the polarization of the incident microwave.

3. The antenna as claimed in claim 1, wherein said source is positioned so as its phase center is close to the center of said main reflector.

* * * * *